United States Patent [19]

Murasaki

[11] Patent Number: 4,912,511

[45] Date of Patent: Mar. 27, 1990

[54] DEVELOPING DEVICE CAPABLE OF PREVENTING A DEVELOPER FROM PASSING THROUGH THE SPACE BETWEEN ADJACENT DEVELOPING SLEEVES

[75] Inventor: Hiroshi Murasaki, Osaka, Japan

[73] Assignee: Minolta Camera Kabushiki Kaisha, Osaka, Japan

[21] Appl. No.: 365,902

[22] Filed: Jun. 15, 1989

[30] Foreign Application Priority Data

Jun. 17, 1988 [JP] Japan ..... 63-150584

[51] Int. Cl.[4] ..... G03G 15/06; G03G 15/09

[52] U.S. Cl. ..... 355/245; 355/251; 355/246; 118/656; 118/657; 118/658

[58] Field of Search ..... 355/251, 253, 254, 245, 355/246; 118/657, 656, 658

[56] References Cited

U.S. PATENT DOCUMENTS

| | | | |
|---|---|---|---|
| 3,608,522 | 9/1971 | Davidson | 118/658 |
| 3,855,969 | 12/1974 | Andrako . | |
| 4,048,957 | 9/1977 | Tagawa | 355/251 |
| 4,436,055 | 3/1984 | Yamashita et al. . | |
| 4,575,218 | 3/1986 | Sakamoto et al. . | |
| 4,800,412 | 1/1989 | Ueda | 118/658 X |
| 4,833,504 | 5/1989 | Parker et al. | 118/658 X |
| 4,851,872 | 7/1989 | Murasaki et al. | 118/658 X |

FOREIGN PATENT DOCUMENTS

| | | | |
|---|---|---|---|
| 52-17829 | 2/1977 | Japan . | |
| 0203974 | 10/1985 | Japan | 355/251 |

*Primary Examiner*—A. T. Grimley
*Assistant Examiner*—Nestor R. Ramirez
*Attorney, Agent, or Firm*—Burns, Doane, Swecker & Mathis

[57] ABSTRACT

A developing device including first and second developing sleeves rotatable in the same direction and being disposed adjacent to each other and magnets unrotatable and fixedly mounted in the respective developing sleeves. The first magnet mounted within the first developing sleeve has a first magnetic pole slightly downstream of the position at which the first developing sleeve and the second developing sleeve are closest to each other with respect to the rotational direction of the first developing sleeve. The second magnet mounted within the second developing sleeve has a second magnetic pole slightly upstream of the above-described closest position with respect to the rotational direction of the second developing sleeve. A developer being transported by the first developing sleeve on the peripheral surface thereof is attracted by the second magnetic pole of the second developing sleeve in the region in which the first and second developing sleeves confront each other, thus being transferred easily from the peripheral surface of the first sleeve to that of the second sleeve. A developer being transported by the second developing sleeve on the peripheral surface thereof is attracted by the first magnetic pole of the first developing sleeve in the region in which both developing sleeves confront each other, thus being transferred easily from the peripheral surface of the second sleeve to that of the first sleeve. A repellent magnetic field is generated by the first and second magnetic poles between the region in which both developing sleeves confront each other.

6 Claims, 4 Drawing Sheets

Vb2
Vb1
Vrms
Vss

DEVELOPING DEVICE CAPABLE OF PREVENTING A DEVELOPER FROM PASSING THROUGH THE SPACE BETWEEN ADJACENT DEVELOPING SLEEVES

BACKGROUND OF THE INVENTION

1. Field of the invention

The present invention relates to a developing device for use in an image forming apparatus, and more particularly, to a developing device in which an electrostatic latent image formed on an electrostatic latent image carrying member is developed into a visible image by using a two-component developer consisting of a toner and a carrier.

2. Description of the related art

Heretofore, developing device are proposed in, for example, U.S. Pat. No. 3,855,969 and Japanese Patent Laid-Open Publication No. 52-17829. In accordance with these developing devices, developing sleeves in which a plurality of magnets are unrotatably disposed are arranged adjacent to each other in confrontation with an electrostatic latent image carrying member.

According to the above-described developing devices, a two-component developer consisting of a toner and a carrier is held by the developing sleeves on the peripheral surfaces thereof in the form of magnetic brush along magnetic lines of force generated by magnets. The developer is transported from one developing sleeve to the other adjacent developing sleeve according to the rotations thereof. While the developer is being transported thus, the developer contacts with the surface of the electrostatic latent image carrying member. As a result, an electrostatic latent image formed on the electrostatic latent image carrying member is developed into a visible image.

Supposing that the developer is allowed to pass through the space between adjacent developing sleeves of the developing device, the amount of the developer which passes through the space therebetween varies depending on conditions, which makes it difficult to stably transport a predetermined amount of the developer to each of the developing regions of the developing sleeves.

The developer is subjected to forces in different directions in the space between the adjacent developing sleeves. As a result, the developer is likely to stay there, which may apply a heavy load on the driving system of the developing sleeves o prevent the developer from being transported from one developing sleeve to the other. Consequently, the developer leaves the developing sleeves.

Further, it is difficult to quantitatively control the amount of the developer which passes through the space between the adjacent developing sleeves, which makes it difficult to set an appropriate gap between the respective developing sleeves and the electrostatic latent image carrying member and between the adjacent enveloping sleeves. Thus, it is very difficult to appropriately design the developing device.

Furthermore, in a developing device in which a toner is supplied to a developer which is circulating in the periphery of a developing sleeve so as to charge the toner by mixing a carrier and the toner with each other, an uncharged toner may be supplied to the electrostatic latent image carrying member. Consequently, a sheet on which the image of an original document has been copied has undesired black portions, hence an unfavorable image quality.

In order to overcome the disadvantages described above, it is necessary to prevent the developer from passing through the space between the adjacent developing sleeves. To this end, as shown in Japanese Laid-open Patent Publication No. 52-17829 magnetic poles Sa, Na and Sb, Nb are mounted within developing sleeves 51 and 52 respectively so that the magnetic poles S and Nb confront each other and Na and Sb confront each other. Owing to this arrangement of the magnetic poles, the developer is transferred between the developing sleeve 51 and the developing sleeve 52 and in addition, the developer can be prevented from flowing into the space between the developing sleeves 51 and 52.

However, if a developing sleeve whose diameter is small is used to manufacture a compact developing device, small magnets are mounted within the developing sleeve. As a result, the forces of the magnetic poles become small, i.e., the forces for the magnets to attract the developer to the peripheral surface of developing sleeve become small. Thus, a preferable development cannot be carried out in the developing regions or the carrier adheres to the surface of an electrostatic latent image carrying member, or a photosensitive drum.

SUMMARY OF THE INVENTION

Accordingly, it is an essential object of the present invention to provide a compact developing device in which a few magnetic field generating means, for example, magnets are capable of preventing a developer from passing through the space between adjacent developing sleeves.

The developing device in accordance with the present invention having a plurality of developing sleeves comprises a rotatable first developing sleeve which confronts an electrostatic latent image carrying member; a second developing sleeve rotatable in the same direction as the first developing sleeve and disposed in confrontation with the electrostatic latent image carrying member and being adjacent to the first developing sleeve; a first magnet member unrotatably provided within the first developing sleeve so as to hold a developer on the peripheral surface of the first developing sleeve and having a first magnetic pole in the region at which the first and second developing sleeves confront each other; the first magnetic pole, in the rotational direction of the first developing sleeve, being disposed downstream of the position at which the first and second developing sleeves are closest to each other and confronting the first unmagnetic portion of the second developing sleeve; a second magnet member unrotatably provided within the second developing sleeve so as to hold the developer on the peripheral surface of the second developing sleeve and having a second magnetic pole whose polarity is the same as that of the first magnetic pole of the first developing sleeve in the region at which the first and second developing sleeves confront each other; the second magnetic pole, in the rotational direction of the second developing sleeve, being disposed downstream of the position at which the first and second developing sleeves are closest to each other and confronting the second unmagnetic portion of the first developing sleeve.

According to the developing device, a two-component developer consisting of the toner and the carrier is transported in the peripheries of the first and second developing sleeves along the circular stream of a developer generated around the first and second developing sleeves.

The developer which has been transported by the first developing sleeve on the peripheral surface thereof is magnetically attracted by the second magnet member disposed within the second developing sleeve upstream of the position at which both developing sleeves are closest to each other, thus being transferred from the first developing sleeve to the peripheral surface of second developing sleeve. In this case, no magnets are counted within the first developing sleeve in the portion thereof which confronts the second magnetic member. That is, this portion is unmagnetic. Accordingly, the force for this portion to hold the developer thereon is small, which allows the developer to move easily from the first developing sleeve to the second developing sleeve.

The developer which has been transported by the second developing sleeve on the peripheral surface thereof is magnetically attracted by the first magnet member disposed within the first developing sleeve upstream of the position at which both developing sleeves are closest to each other, thus being transferred from the second developing sleeve to the peripheral surface of first developing sleeve. In this case, no magnets are mounted in the second developing sleeve at the portion thereof which confronts the first magnetic member. That is, this portion is unmagnetic. Accordingly, the force for this portion to hold the developer thereon is small, which allows the developer to move easily from tee second developing sleeve to the first developing sleeve.

Further, since a repellent magnetic field is generated by the first and second magnet members between the space in which both developing sleeves confront each other the developer is prevented from entering into the space therebetween, which allows the developer to move between both developing sleeves.

According to the present invention, since the developer can be prevented from being transported into the space between both developing sleeves although only a few magnetic pole are used, the number of magnets to be provided in the developing sleeves can be reduced which contributes to the manufacture of a compact developing sleeve and device, namely, a compact image forming apparatus.

BRIEF DESCRIPTION OF THE DRAWINGS

These and other objects and features of the present invention will become apparent from the following description take in conjunction with the preferred embodiments thereof with reference to the accompanying drawings, in which.

DETAILED DESCRIPTION OF THE INVENTION

Figure 1:
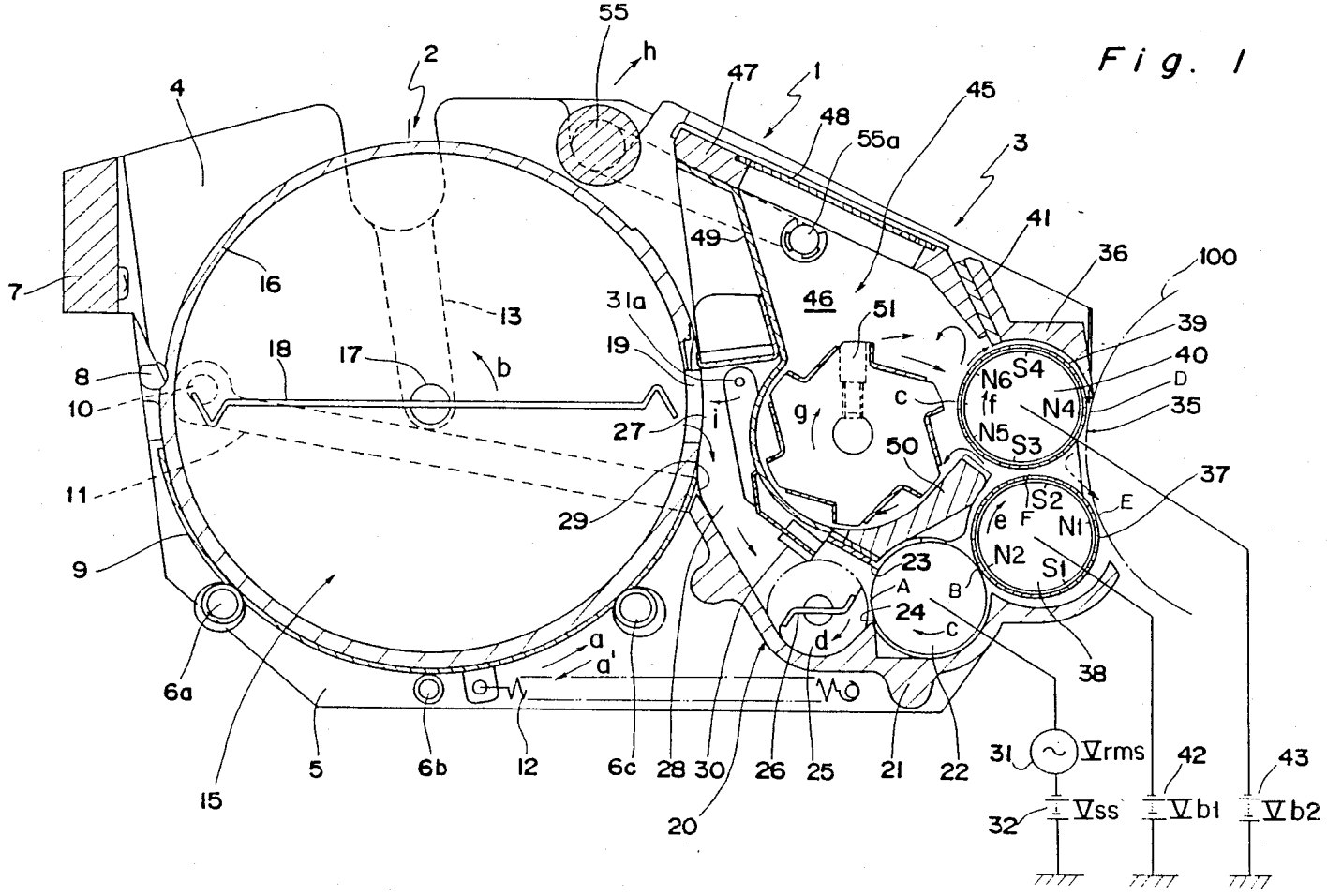
FIG. 1 is a sectional view showing a developing device in accordance with a first embodiment of the present invention.

Before the description of the present invention proceeds, it is to be noted that like pats are designated by like reference numerals throughout the accompanying drawings.

(First embodiment)

CONSTRUCTION OF DEVELOPING DEVICE (i) Schematic construction

Referring now to the drawings, and FIG. 1 in particular, there is shown a developing apparatus 1, in accordance with a first embodiment of the present invention, which faces a photosensitive drum 100 essentially comprises a toner supplying device 2 and a developing device 3.

(ii) Toner supplying device 2

A toner cartridge 15 accommodating an insulating and unmagnetic toner is mounted in a cartridge accommodating section 4 of the toner supplying device 2.

In the cartridge accommodating section 4, a rear wall 7 and three supporting members *6a*, *6b*, and *6c* are fixed to a pair of side plates 5 and 5 composing the side walls of the developing device 1 (only one of the side plates 5 and 5 is shown in FIG. 1.) The supporting members *6a*, *6b*, and *6c* support an approximately semicylindrical bottom plate 9. Both sides of the right end of the bottom plate 9 are connected with a pair of levers 11 rotatably mounted on the side plates 5 and 5 through axes 10 and 10. One of the ends of a spring 12 is secured by the bottom plate 9 at the bottom portion thereof, thus urging the bottom plate 9 counterclockwise in FIG. 1, namely, toward the direction shown by an arrow (a). The other end of the spring 12 is attached to the side plate 5. When the toner cartridge 15 is removed from the cartridge accommodating section 4, the bottom plate 9 rotates in the direction shown by the arrow (a), thus closing a toner supplying opening 27 of the developing unit 3 which is described later.

The toner cartridge 15 comprises a cylinder 16 whose end faces are covered with plates, an agitating blade 18 rotatably mounted in the cylinder through a trunnion axis 17, and an opening 19 formed on the cylinder 16 in the axial direction thereof.

When the toner cartridge 15 is put into the cartridge accommodating section 4, the trunnion axis 17 is moved downward along guide grooves 13 and 13 formed on the side plates 5 and 5. Then, the toner cartridge 15 is rotated clockwise so that the opening 19 coincides with the toner supplying opening 27 of the developing unit 3.

When the toner cartridge 15 is mounted in the cartridge accommodating section 4, each of the trunnion axes 17 presses the corresponding lever 11 downward, i.e., rotates the lever 11 clockwise. As a result, the bottom plate 9 rotates clockwise, namely, in the direction shown by an arrow (a') about the axis 10 against the urging force of the spring 12. Consequently, the toner supplying opening 27 is opened.

A locking portion 8 formed on the rear wall 7 stabilizes the toner cartridge 15 in the cartridge accommodating section 4. When the tone cartridge 15 is mounted in the cartridge accommodating section 4, a handle 55 disposed in the cartridge accommodating section 4, and adapted for transporting the entire developing unit 3 is rotated in the direction shown by the arrow (h) about a supporting point *55a*. Therefore, the handle does not prevent the toner cartridge 15 from being mounted on the cartridge accommodating section 4.

(iii) Developing unit 3

The developing unit 3 comprises a toner supplying section 20, a developing section 35, and a developer agitating section 45.

(1) Toner supplying section 20

The toner supplying section 20 receives a toner supplied from the toner cartridge 15, thus supplying the toner to the developing section 35.

The toner supplying section 20 comprises a bottom frame 21 of the developing unit 3, partitioning walls 49, 50 which partition a developer agitating section 45 from the toner supplying section 20, a toner supplying roller 22 disposed between the bottom frame 21 and the partitioning walls 49, 50, and a toner hopper 25 having an agitating blade 26 disposed on the left side of the toner supplying roller 22.

The toner supplying roller 22 is made of conductive material such as aluminum and has fine convexes and concaves formed on the peripheral surface thereof. An unshown drive source rotates the toner supplying roller 22 clockwise, namely, in the direction shown by an arrow (c) in FIG. 1. A thin blade 23 formed on the partitioning wall 50 and a toner outflow preventing film 24 formed on the bottom frame 21 are in close contact with the toner supplying roller 22 on the upper portion and lower portion of the peripheral surface thereof, respectively. The toner outflow preventing film 24 serves as a means for preventing a toner in the toner hopper 25 from falling below the toner supplying roller 22.

A bias voltage Vs (=Vrms+Vss) is applied to the toner supplying roller 22 by an AC power source 31 and a DC power source 32 so that a developer is collected from a first developing sleeve 37 which is described later.

The toner hopper 25 communicates with the toner supplying opening 27 through a path 28 in which a toner-empty detecting device 30 rotatable about a supporting point 31*a* is mounted. A toner spill preventing sheet 29 is mounted below the toner supplying opening 27. The top end of the toner spill preventing sheet 29 is in contact with the peripheral surface of the toner cartridge 15 so that the toner does not spill out of a gap between the developing unit 3 and the toner cartridge 15.

(2) Developing section 35

The developing section 35 receives the toner supplied by the toner supplying section 20 and supplies the toner to an electrostatic latent image formed on the surface of a photosensitive drum 100, namely, an electrostatic latent image carrying member while transporting the toner and the magnetic carrier.

In the developing section 35, a first developing sleeve 37 and a second developing sleeve 39 are disposed in the space formed between the bottom frame 21 and a sleeve cover 36 with the former locating above the latter. A predetermined slight gap is provided between the first developing sleeve 37 and the toner supplying roller 22. There is also provided a gap between the upper peripheral surface of the second developing sleeve 39 and a developer height restricting plate 41 mounted on the sleeve cover 36 at the left portion thereof. As described later, the developer height restricting plate 41 restricts the height of the developer which is transported thereto in the form of a magnetic brush.

The developing sleeves 37 and 39 are rotated clockwise as shown by arrows (e) and (f) by an unshown drive source.

Developing bias voltages $Vb_1$ and $Vb_2$ are applied to the developing sleeves 37 and 39, respectively by DC power sources 42 and 43. Magnetic members 38 and 40 are unrotatably accommodated within the developing sleeves 37 and 39, respectively.

The magnetic member 38 comprises four magnetic poles $N_1$, $N_2$, $S_l$, and $S_2$ arranged on the inner circumferential face of the developing sleeve 37. In this arrangement, the magnetic pole $N_1$ is disposed at the position at which the first developing sleeve 37 confronts the photosensitive drum 100. The magnetic pole $N_2$ is disposed at the position at which the first developing sleeve 37 confronts the toner supplying roller 22. The magnetic poles S1 and S2 are arranged between the magnetic poles $N_1$ and $N_2$. In detail, the magnetic pole $S_1$ is disposed below the straight line drawn from the magnetic pole $N_1$ to $N_2$. The magnetic pole $S_2$ is disposed on the right side of the position (F) which is nearest the developing sleeve 39. Therefore, the circular arc between the magnetic pole $N_2$ and the magnetic pole $S_2$ is relatively great compared with the circular arcs formed between the adjacent magnetic poles.

The magnetic member 40 comprises five magnetic poles $N_4$, $N_5$, $N_6$, $S_3$, and $S_4$ arranged in the inner circumferential face of the developing sleeve 39. In this arrangement, the magnetic pole $N_4$ is disposed at the position at which the second developing sleeve 39 confronts the photosensitive drum 100. The magnetic poles $N_5$ and $N_6$ adjacent to each other are disposed at the position at which the second developing sleeve 39 confronts the developer agitating section 45. The magnetic pole $S_3$ is disposed on the left side of the position (F) which is nearest the developing sleeve 37. The magnetic pole $S_4$ disposed between the magnetic poles $N_4$ and $N_6$ is provided on the right side of the position at which the developing sleeve 39 and the developer height restricting plate 41 confront each other.

Figure 2:
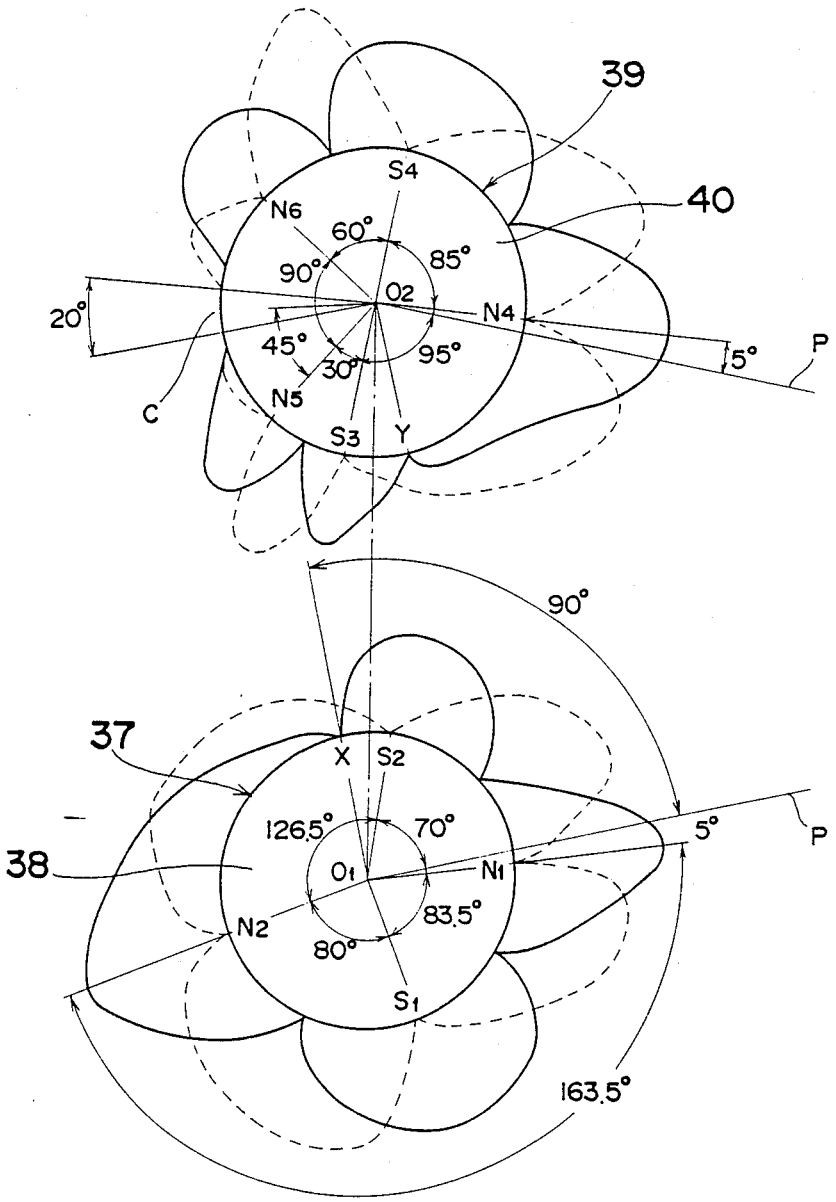
FIG. 2 is a view showing the distribution of the magnetic force of a magnetic member.
Figure 3:
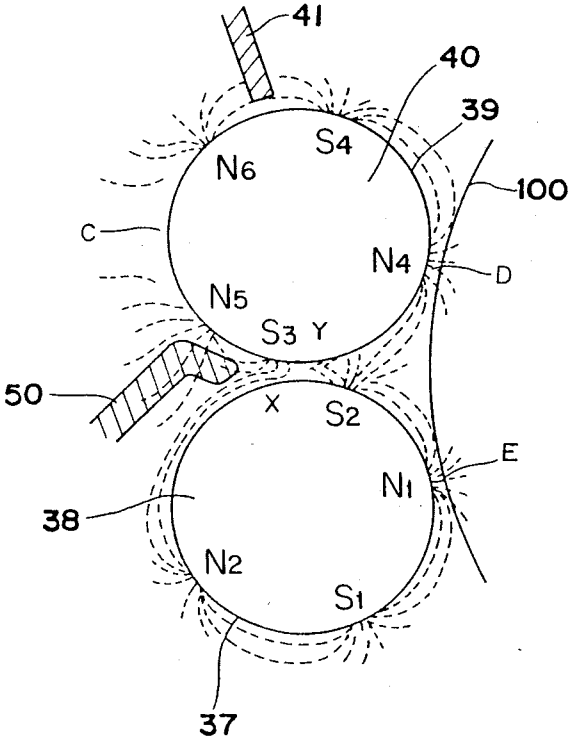
FIG. 3 is a view showing the distribution of the magnetic lines of force of the magnetic member.
Figure 5:
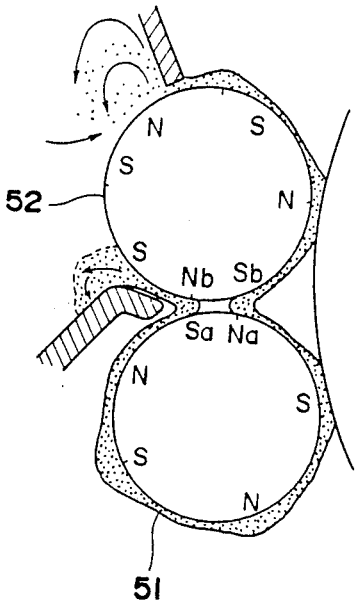
Fig. 5 PRIOR ART
FIG. 5 is a sectional view showing the arrangement of magnetic poles of a known developing device, as previously described.

FIG. 2 shows how the magnetic forces formed by the magnetic poles arranged as described above are distributed in the peripheries of the developing sleeves 37 and 39. FIG. 3 shows how the magnetic lines of force are generated by the magnetic poles thus arranged.

Referring to FIG. 2, the centers of the circles in sectional views of the developing sleeves 37 and 39 are designated by $O_1$ and $O_2$, respectively. The straight lines which connect the center of the photosensitive drum 100 and the centers $O_1$ and $O_2$ to each other are denoted by (P), respectively.

The developing sleeves 37 and 39 confront each other in the direction shown by a dashed line, namely, the straight line formed by connecting the centers of the developing sleeves 37 and 39 to each other. The region of the developing sleeve 39 which confronts the magnetic pole $S_2$ through the developing sleeves 37 and 39 is designated by (Y) and the region of the developing sleeve 37 which confronts the magnetic pole $S_3$ through the developing sleeves 37 and 39 is designated by (X).

Magnetic fluxes generated by the magnetic poles of the developing sleeves 37 and 39 were measured by magnetometers placed normal and parallel to the magnetic fluxes. Solid lines and dotted lines in FIG. 2 indicate the measured components of magnetic forces along the normal and tangential lines of the peripheral surface of the developing sleeves 37 and 39.

As understood from FIG. 2, the intensities of the magnetic forces, of the regions (X) and (Y), along the normal lines of the peripheral surfaces of the developing sleeves 37 and 39 are much lower than those of the magnetic forces, of the other regions, along the normal lines of the peripheral surfaces thereof, namely, zero. An unmagnetic region (C), namely, a region having no magnetic force is formed between the magnetic poles $N_5$ and $N_6$.

Describing the arrangement of the magnetic poles in detail, the magnetic pole $N_1$ of the magnetic member 38 forms 5° with the line (P) in the downstream portion of the rotational direction of the developing sleeve 37 so that a carrier is prevented from adhering to the photosensitive drum 100.

The magnetic pole $N_4$ of the magnetic member 40 forms 5° with the line (P) in the upstream portion of the rotational direction of the developing sleeve 39 so that a favorable development is carried out.

(3) Developer agitating section 45

The developer agitating section 45 is provided in the developing unit 3 to agitate the developer including carrier and toner which has been supplied from the toner supplying section 20 to the developing section 35.

The developer agitating section 45 comprises a developer agitating chamber 46 disposed rearward (left side in FIG. 1) of the developing sleeve 39, a frame 47 disposed on the upper portion thereof, the partitioning walls 49 and 50 disposed on the rear (left side in FIG. 1) and bottom portions thereof, and a bucket roller 51 rotatable in the direction shown by an arrow (g). The right end portion of the partitioning wall 50 is disposed in the position at which the developing sleeves 37 and 39 confront each other.

A lid 48 is disposed adjacent to the frame 47 so that a starter consisting of the toner and the carrier which have been mixed with each other at a predetermined ratio is put therefrom into the developer agitating chamber 46.

A two-component developer consisting of the toner and the carrier is held by the developing sleeves 37 and 39 on the peripheral surface thereof.

OPERATION OF DEVELOPING DEVICE

When the developing device 1 having the above-described construction is mounted on an image forming apparatus such as a copying machine, the agitating blades 18 and 26, the toner supplying roller 22, the developing sleeves 37 and 39, and the bucket roller 51 are connected to the unshown driving system.

When the developing device 1 is driven, the agitating blade 18 of the toner cartridge 15 rotates in the direction shown by the arrow (b). As a result, toner particles are agitated, thus being transported to the path 28 through the opening 19 and the toner supplying opening 27 which coincide with each other.

The toner which has been transported to the toner hopper 25 is transported to the toner supplying roller 22 while they are being agitated through the agitating blade 26 which rotates in the direction shown by the arrow (d), then held by the toner supplying roller 22 in the region (A) which faces the toner hopper 25. Thereafter, the toner supplying roller 22 transports the toner in the direction shown by the arrow (c). The blade 23 restricts the amount of the toner to be transported to the toner supplying region (B). Toner particles which have been scraped off the peripheral surface of the toner supplying roller 22 by the blade 23 return to the toner hopper 25. Toner particles which have passed the blade 23 are transported to the toner supplying region (B) in which the developing sleeve 37 and the toner supplying roller 22 confront each other. In the toner supplying region (B), some of the toner particles are supplied to the peripheral surface of the developing sleeve 37 by scraping action of the magnetic brushes formed on the developing sleeve 37 and electrostatic attractive force based on the electric potential difference between the developing bias voltage $Vb_1$ applied to the developing sleeve 37 and the bias voltage Vs (=Vrms+Vss) applied to the tone supplying roller 22.

Simultaneously with the toner supplying operation, a toner collecting operation is performed in the toner supplying region (B). That is, surplus toner particles on the developing sleeve 37 are collected back to the toner supplying roller 22 according t the electrostatic attractive force described above, whereby the toner density (percentage of toner with respect to developer) of the developer held o the developing sleeve 37 is kept to be a predetermined constant value.

The toner which has returned to the toner supplying roller 22 is transported in the direction shown by the arrow (c) to the toner hopper 25 through the toner outflow preventing film 24.

Figure 4:
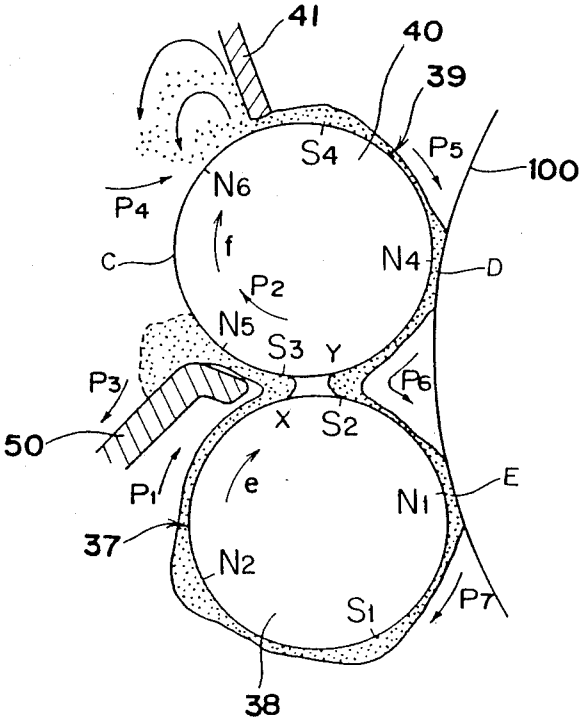
FIG. 4 is a sectional view showing the transportation of a developer to be carried out by developing sleeves thereon.

The toner is supplied from the toner hopper 25 to a developer held on the developing sleeve 37 in the form of a magnetic brush along the magnetic lines of forces shown in FIG. 3, then transported along the stream $P_1$ of the developer (direction shown by the arrow (e)) in FIG. 4 according to the rotation of the developing sleeve 37. While the developer and the toner are being transported, the developer and the toner ar mixed with each other on the developing sleeve 37 by the rotation of the developing sleeve 37 with respect to the magnetic member 38 and the magnetic force of the magnetic member 38. As a result, the electric potential of the toner rises.

When the developer transported on the developing sleeve 37 along the stream $P_1$ of the developer reaches the portion at which the developing sleeves 37 and 39 confront each other, the developer is attracted by the magnetic pole $S_3$ along the magnetic lines of forces generated by the magnetic pole $S_3$ of the developing sleeve 39, thus being transferred from the developing sleeve 37 to the developing sleeve 39.

As described previously, the intensity of the magnetic force of the region (X) which confronts the magnetic pole $S_3$ of the developing sleeve 39 is set to be much smaller than the intensities of the regions in the periphery thereof and a repellent magnetic field is generated by the magnetic poles $S_2$ and $S_3$ between the developing sleeves 37 and 39. Therefore, the developer is prevented from flowing into the space in the vicinity of the position at which the developing sleeves 37 and 39 confront each other, but all the developer is transferred to the developing sleeve 39.

The developer which has been transferred from the surface of tee developing sleeve 37 to the developing sleeve 39 is transported along the stream $P_2$ of the developer (direction shown by an arrow (f)) in FIG. 4 according to the rotation of the developing sleeve 39, then leaves the developing sleeve 39 in the unmagnetic portion (C) thereof formed between the magnetic poles $N_5$ and $N_6$, thus flowing into the agitating chamber 46.

The direction in which the developer is transported by the developing sleeve 37 on the peripheral surface thereof differ from the direction in which the developer is transported by the developing sleeve 39 on the peripheral surface thereof. That is, as shown in FIG. 4, when the developer reaches the portion at which the developing sleeve 37 and 39 face each other, the direction in which the developer is transported changes from (e) to (f). Accordingly, the developer particles are stirred in some extent.

Thereafter, the developer circulates in the agitating chamber 46 and is transported in the direction shown by the arrow (g) according to the rotation of the bucket roller 51 while the toner and the carrier are being mixed with each other and agitated.

The developer being mixed with each other and stirred in the agitating chamber 46 is transported toward the developing sleeve 39 along the stream $P_4$ of the developer shown in FIG. 4, then partly held by the developing sleeve 39 on the portion which coincides with the magnetic pole $N_6$. Thereafter, the developer is transported in the direction shown by the arrow (f), then reaches the developer height restricting plate 41 which restricts the amount of the developer to be transported toward a developing region (D).

The developer which has passed the space between the developer height restricting plate 41 and the developing sleeve 39 is transported in the form of a magnetic brush along the stream $P_5$ of the developer (direction shown by the arrow (f)). When the developer reaches the developing region (D) at which the photosensitive drum 100 and the developing sleeve 39 confront each other, the developer frictionally contacts with an electrostatic latent image formed on the peripheral surface of the photosensitive drum 100 to form a toner image.

The developer which has passed through the developing region (D) is transported in the direction shown by the arrow (f) according to the rotation of the developing sleeve 39. Then, the developer being transported along the stream $P_6$ of the developer shown in FIG. 4 is attracted by the magnetic pole $S_2$ of the magnetic member 38. As a result, the developer is held by the developing sleeve 37.

Similarly to the transfer of the developer from the developing sleeve 37 to the developing sleeve 39, the intensity of the magnetic force of the region (Y) which confront the magnetic pole $S_2$ of the developing sleeve 37 is set to be much lower than the intensities of the magnetic forces in the peripheries thereof and a repellent magnetic field is generated by the magnetic poles $S_2$ and $S_3$ in the space between the developing sleeves 37 and 39. Accordingly, the developer is smoothly transferred from the developing sleeve 39 to the developing sleeve 37, which does not allow the developer to flow into the space between the developing sleeves 37 and 39.

The developer which has moved to the surface of the developing sleeve 37 is transported in the direction shown by the arrow (e) according to the rotation of the developing sleeve 37, then again frictionally contacts with the electrostatic latent image formed on the photosensitive drum 100. Thus, a toner is supplied again to the toner image formed in the developing region (E) in which the toner frictionally contacts with portions of the electrostatic latent image to which the toner has been insufficiently supplied in the region (D). Since the toner is uniformly supplied to the electrostatic latent image, a sheet on which the image of an original document has been copied has neither an ununiform density nor undeveloped portions.

A development is carried out in the developing regions (D) based on the electric potential difference between the developing bias voltage $Vb_2$ and electric potential of the surface of the photosensitive drum 100. Similarly, a development is carried out in the developing regions (E) based on the electric potential difference between the developing bias voltage $Vb_l$ and the electric potential of the surface of the photosensitive drum 100.

The developer which has passed through the developing region (E) is transported to the toner supplying roller 22 along the stream $P_7$ of the developer. In the toner supplying region (B), a toner is supplied to the developer in an amount equal to the amount consumed by the developments.

As described previously, the toner which has been supplied to the developing sleeve 37 in the toner supplying region (B) is transported to the peripheral surface of the developing sleeve 39.

Thus, the amount of the toner accommodated in the toner cartridge 15 gradually decreases. When the amount of the toner in the toner hopper 25 and the path 28 is reduced less than a predetermined amount, the toner-empty detecting device 30 rotates clockwise, namely, in the direction shown by the arrow (i). Thus, the toner-empty detecting device 30 detects that the toner cartridge 15 is required to be replaced.

The toner-empty state is terminated by mounting a new toner cartridge 15, which accommodates a sufficient amount of a toner, in the cartridge accommodating section 4. (Other embodiments)

According to the above description, the developing device is provided with two developing sleeves 37 and 39. Further, the present invention is applicable to a developing device provided with more developing sleeves.

In the above-described embodiment, the present invention is applied to a developing device in which a toner is supplied to a developer being transported on the surface of the developing sleeves 37 and 39. The present invention is also applicable to a developing device in which a toner mixed previously with a carrier is supplied to developing sleeves.

In the embodiment described above, the photosensitive drum 100 is used as the electrostatic latent image carrying member. A developing device in accordance with the present invention is applicable as well to an image forming apparatus in which a photosensitive member comprising a belt is used.

Although the present invention as been fully described in connection with the preferred embodiments thereof with reference to the accompanying drawings, it is to be noted that various changes and modification are apparent to those skilled in the art. Such changes and modifications are to be understood as included within the scope of the present invention as defined by the appended claims unless they depart therefrom.

What is claimed is:

1. A developing device having a plurality of developing sleeves comprising:

a first developing sleeve which is rotatable and confronts an electrostatic latent image carrying member;

a second developing sleeve rotatable in the same direction as that of said first developing sleeve and disposed in confrontation with said electrostatic latent image carrying member and being adjacent to said first developing sleeve;

a first magnet member fixedly provided within said first developing sleeve so as to hold a developer on the peripheral surface of said first developing sleeve and having a first magnetic pole in the region at which said first and second developing sleeves confront each other;

said first magnetic pole, in the rotational direction of said first developing sleeve, being disposed downstream of a position at which said first and second developing sleeves are closest to each other and confronting a first unmagnetic portion of said second developing sleeve;

a second magnet member fixedly provided within said second developing sleeve so as to hold the developer on the peripheral surface of the second developing sleeve and having a second magnetic pole whose polarity is the same as that of said first magnetic pole of said first developing sleeve in the region at which said first and second developing sleeves confront each other;

said second magnetic pole, in the rotational direction of said second developing sleeve, being disposed downstream of the position at which said first and second developing sleeves are closest to each other and confronting a second unmagnetic portion of said first developing sleeve.

2. A developing device as claimed in claim 1, said developing device further comprising:

a restricting member which restricts an amount of the developer consisting of a toner and a carrier, which is transported by said first and second developing sleeves on the peripheral surfaces thereof, and is provided in confrontation with said second developing sleeve in the portion upstream, in the rotational direction of said second developing sleeve, of the region at which said second developing sleeve and said electrostatic latent image carrying member confront with each other; and tone supplying means for supplying a toner to the peripheral surface of said first developing sleeve.

3. A developing device as claimed in claim 2, wherein said toner supplying means includes a toner hopper which accommodates the toner and a supplying roller rotatably provided s as to receive the toner from said toner hopper and to supply the toner to the first developing sleeve.

4. A developing device as claimed in claim 3, wherein said first developing sleeve is disposed below said second developing sleeve.

5. A developing device comprising:

toner supplying means;

developing means for receiving a toner from said toner supplying means on the side opposite to an electrostatic latent image carrying member and supplying the toner to said electrostatic latent image carrying member while transporting the toner and a magnetic carrier;

developer agitating means for receiving, on the side opposite to said electrostatic latent image carrying member, the toner supplied from said toner supplying means to said developing means and the carrier transported by said developing means before the toner is supplied from said developing means to said electrostatic latent image carrying member, agitating the toner together with the carrier, and supplying an agitated developer to said developing means, said developing means comprising:

a first developing sleeve disposed in confrontation with said electrostatic latent image carrying member so as to receive the toner from said toner supplying means on the side opposite to said electrostatic latent image carrying member and rotating to transport the developer in the order of said electrostatic latent image carrying member and said toner supplying means;

a second developing sleeve rotatable in the same direction as that of said first developing sleeve, being disposed in confrontation with said electrostatic latent image carrying member, being adjacent to said first developing sleeve;

a first magnet member fixedly provided within said first developing sleeve so as to hold the developer on the peripheral surface of said first developing sleeve and having a first magnetic pole in the region at which said first and second developing sleeves confront each other;

said first magnetic pole, in the rotational direction of said first developing sleeve, being disposed downstream of a position at which said first and second developing sleeves are closest to each other and confronting the first unmagnetic portion of said second developing sleeve;

a second magnet member fixedly provided within said second developing sleeve so as to hold the developer on the peripheral surface of said second developing sleeve and having a second magnetic pole whose polarity is the same as that of said first magnetic pole of said first developing sleeve in the region at which said first and second developing sleeves confront each other;

said second magnetic pole, in the rotational direction of sad second developing sleeve, being disposed downstream of the position at which said first and second developing sleeves are closes to each other and confronting the second unmagnetic portion of said first developing sleeve.

6. A developing device as claimed in claim 5, wherein said second magnet member further includes third and fourth magnetic poles, whose polarities are opposite to the polarity of said second magnetic pole, in the downstream portion of said second magnetic pole with respect to the rotational direction of said second developing sleeve;

said third and fourth magnetic poles form a third unmagnetic portion therebetween; and said developer agitating member is disposed in confrontation with said third unmagnetic portion of said second developing sleeve, whereby the developer which has been transported from said first developing sleeve to said second developing sleeve leaves said second developing sleeve in said third unmagnetic portion and is supplied to said developer agitating means.

* * * * *